US006396038B1

(12) United States Patent
Lee et al.

(10) Patent No.: US 6,396,038 B1
(45) Date of Patent: May 28, 2002

(54) WALL-MOUNTED MICROWAVE OVEN AND METHOD FOR CONTROLLING THE SAME

(75) Inventors: Sung-Ho Lee; Young-Won Cho, both of Suwon; Tae-Soo Kim, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/885,951

(22) Filed: Jun. 22, 2001

(30) Foreign Application Priority Data

Mar. 12, 2001 (KR) ..... 01-12688

(51) Int. Cl.[7] ..... H05B 6/68

(52) U.S. Cl. ..... 219/757; 219/715; 219/721; 126/299 D

(58) Field of Search ..... 219/757, 721, 219/702, 718, 715; 126/299 D, 299 R

(56) References Cited

U.S. PATENT DOCUMENTS 4,198,553 A * 4/1980 Dills ..... 219/718
4,375,587 A * 3/1983 Perl ..... 219/721
4,886,046 A 12/1989 Welch et al. ..... 126/299
5,994,684 A * 11/1999 Ko ..... 219/721
6,025,582 A * 2/2000 Kang et al. ..... 219/757
6,072,169 A * 6/2000 Kang et al. ..... 219/702

* cited by examiner

*Primary Examiner*—Philip H. Leung
(74) *Attorney, Agent, or Firm*—Robert E. Bushnell, Esq.

(57) ABSTRACT

A wall-mounted microwave oven and a method for controlling the same, wherein the microwave oven and a hood unit are prevented from being operated at maximum power at the same time in the initial operation state. The microwave oven comprises a hood unit driver for controlling an operation of the hood unit, power output switching means for controlling the level of a voltage to be supplied to a transformer, and a controller for controlling the hood unit driver and power output switching means to prevent the hood unit and a magnetron from being operated at the maximum power at the same time in the initial operation state. In the initial operation state, the hood motor and microwave oven are prevented from being operated at the maximum power at the same time for a certain period of time. Then, the hood motor and microwave oven are normally operated at the maximum power after the lapse of the certain time period. Therefore, the microwave oven can be controlled in entire power consumption and prevented from being overloaded.

11 Claims, 10 Drawing Sheets

OPERATION OF CONVENTIONAL
WALL-MOUNTED MICROWAVE OVEN

OPERATION OF CONVENTIONAL WALL-MOUNTED MICROWAVE OVEN

WALL-MOUNTED MICROWAVE OVEN AND METHOD FOR CONTROLLING THE SAME

CLAIM OF PRIORITY

This application makes reference to, incorporates the same herein, and claims all benefits accruing under 35 U.S.C. §119 from an application for A WALL MOUNT TYPE MICRO WAVE OVEN AND ITS CONTROL METHOD earlier filed in the Korean Industrial Property Office on Mar. 12, 2001 and there duly assigned Ser. No. 12688/2001 by that Office.

BACKGROUND OF THE INVENTION

1. Field of the Invention

The present invention relates in general to microwave ovens, and more particularly to a wall-mounted microwave oven and a method for controlling the same, wherein the microwave oven and a hood unit are prevented from being operated at maximum power at the same time in the initial operation state.

2. Description of the Prior Art

Microwave ovens are generally adapted to perform a cooking operation based on a super-high frequency, in a different manner from cooking equipment of an external heating type based on thermal conduction and thermal radiation. Such a conventional microwave oven comprises a super-high frequency oscillation tube, or a magnetron, for generating a super-high frequency of 2,470 MHz in response to high-voltage power applied thereto. The super-high frequency of 2,470 MHz generated from the magnetron causes an electric field to turn in direction at a rate of 2.45 billion times per second. Where this super-high frequency is applied to food, molecules of water in the food vibrate at a rate of 2.45 billion times per second while generating a large amount of heat, thereby cooking the food.

FIGS. 1*a* and 1*b* are graphs illustrating the operation of a conventional wall-mounted microwave oven.

As shown in FIGS. 1*a* and 1*b,* the conventional wall-mounted microwave oven is operated simultaneously with a hood motor upon cooking food. For this reason, even in the initial operation state requiring a large amount of power consumption, the microwave oven and the hood motor are together operated, resulting in an increase in power consumption.

Thus, there has been a need for a technique capable of controlling the operation of a microwave oven according to the operation of a hood motor in the initial operation state. However, a conventional wall-mounted microwave oven cannot control its power output level according to the operation of a hood motor, so it cannot effectively solve a power consumption increase or overload.

SUMMARY OF THE INVENTION

Therefore, the present invention has been made in view of the above problem, and it is an object of the present invention to provide a wall-mounted microwave oven and a method for controlling the same, wherein the microwave oven and a hood unit are prevented from being operated at maximum power at the same time for a predetermined period of time in the initial operation state.

In accordance with one aspect of the present invention, the above and other objects can be accomplished by the provision of a wall-mounted microwave oven comprising a hood unit including a hood motor; a magnetron; a transformer having primary and secondary coils, the transformer generating a high voltage in a turn ratio of the primary and secondary coils and supplying the generated high voltage to the magnetron; a hood unit driver for controlling an operation of the hood unit; power output switching means for controlling the level of a voltage to be supplied to the transformer; and a controller for controlling the hood unit driver and power output switching means to prevent the hood unit and magnetron from being operated at maximum power at the same time in an initial operation state.

In accordance with another aspect of the present invention, there is provided a method for controlling a wall-mounted microwave oven, the microwave oven having a hood unit including a hood motor, the method comprising the steps of a) controlling the hood motor and microwave oven to prevent them from being operated at maximum power at the same time for a certain period of time in an initial operation state; and b) normally operating the hood motor and microwave oven at the maximum power after the lapse of the certain time period.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

Figure 1A:
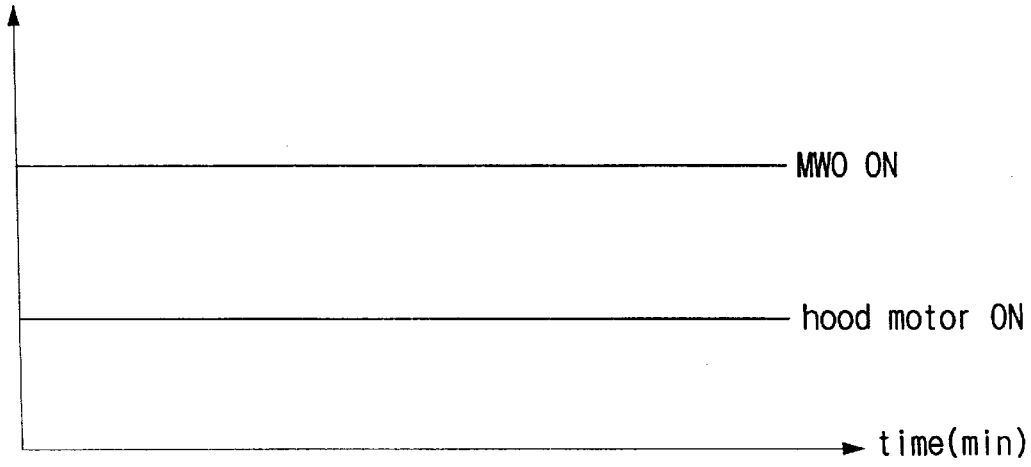
FIGS. 1*a* and 1*b* are graphs illustrating the operation of a conventional wall-mounted microwave oven.
Figure 1B:
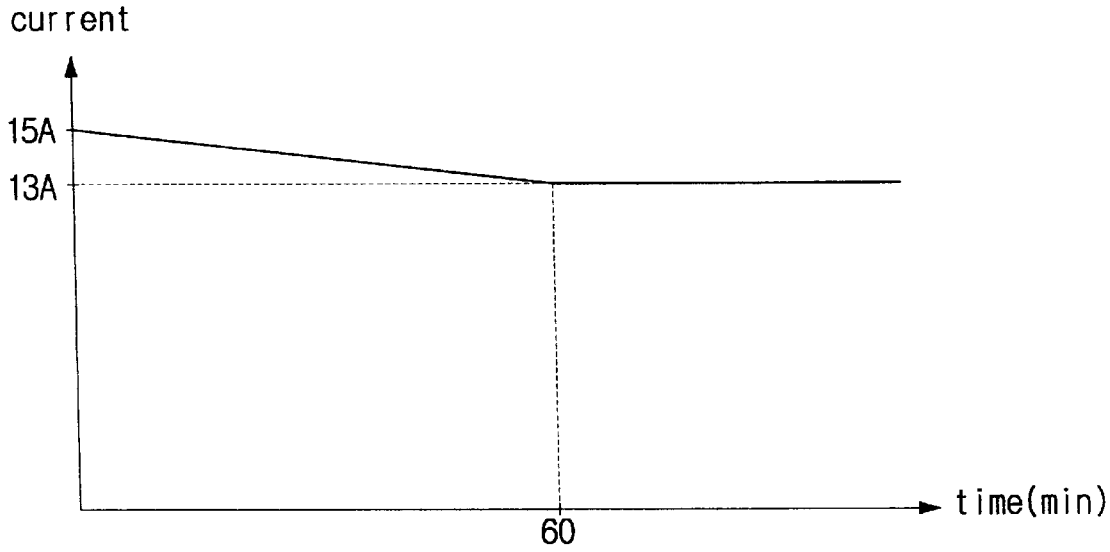
Figure 2:
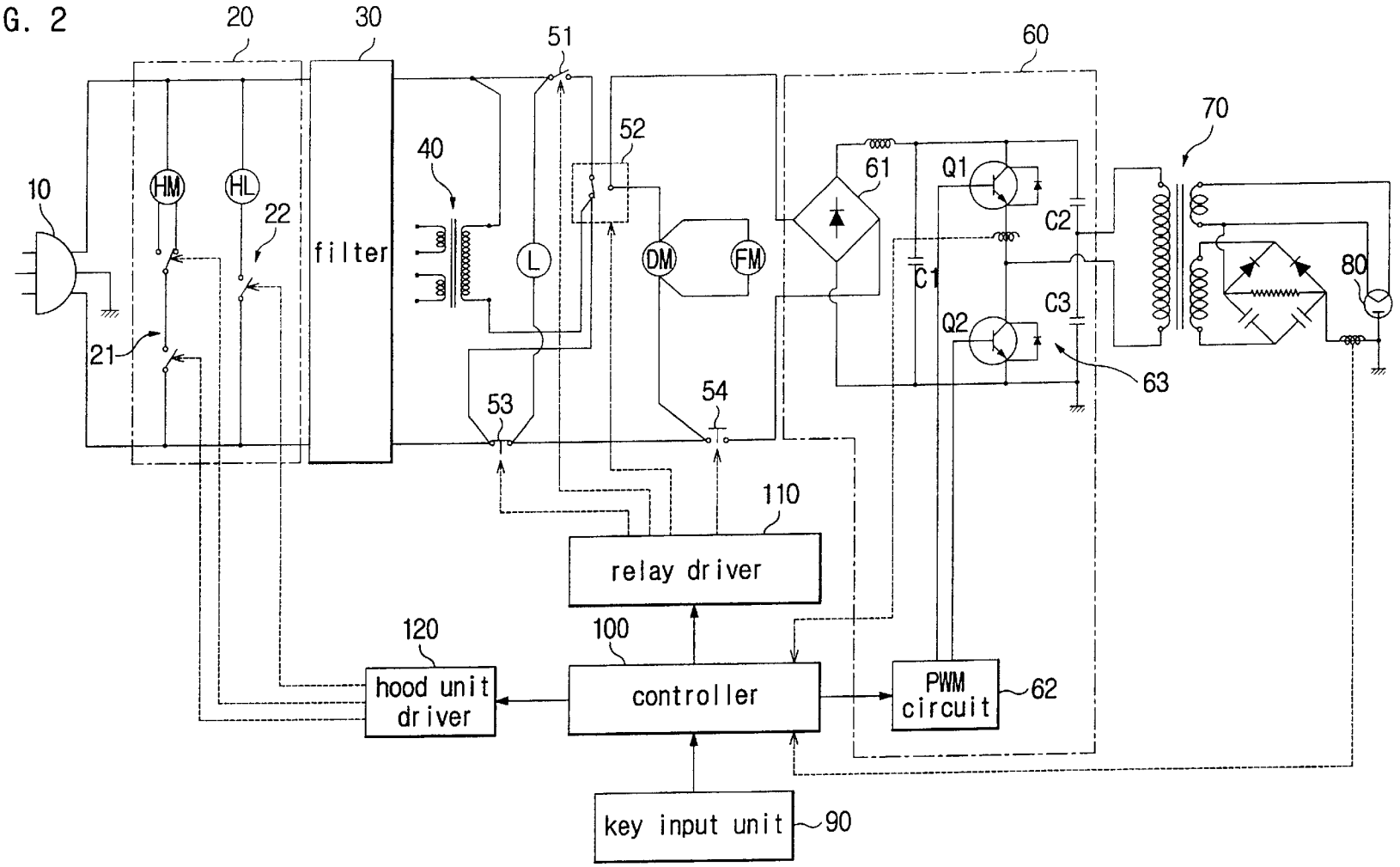
FIG. 2 is a circuit diagram showing the construction of a wall-mounted microwave oven in accordance with the present invention.

FIG. 2 is a circuit diagram showing the construction of a wall-mounted microwave oven in accordance with the present invention.

With reference to FIG. 2, the wall-mounted microwave oven of this invention comprises a hood unit 20 including a hood motor HM, a hood motor relay 21 for switching the operation of the hood motor HM, a hood lamp HL, and a hood lamp relay 22 for switching the operation of the hood lamp HL.

The wall-mounted microwave oven further comprises a controller 100 for controlling the entire operation of the oven, and a key input unit 90 connected electrically to the controller 100 for inputting an operation command from the user. The key input unit 90 inputs a variety of cooking commands and hood unit operation commands from the user and transfers them to the controller 100.

Connected to the output of the controller 100 are a hood unit driver 120 for driving the hood unit 20, a relay driver 110 for driving a variety of relays, which will be described later in detail, and a pulse width modulation (PWM) circuit 62 in power output switching means 60, which will be described later in detail.

The microwave oven further comprises a filter 30 for removing noise from power from an electric cord 10, and a low-voltage transformer 40 for supplying a low voltage to the controller 100. The low-voltage transformer 40 is connected to the electric cord 10 via the filter 30 to receive a voltage from the cord 10, step it down and apply the resulting low voltage to the controller 100.

A primary safety switch 51 is connected to a power line extending from the filter 30 at its one terminal to block or bypass the supply of power from the electric cord 10 according to the opening or shutting of a door of the microwave oven. A monitor switch 52 is connected to the other terminal of the primary safety switch 51 to, when the switch 51 becomes out of order, operate in an opposite manner to the switch 51 so as to form a short circuit. A secondary safety switch 53 is connected to the other terminal of the primary safety switch 51 via the monitor switch 52 at its one terminal and to the one terminal of the switch 51 via a lamp L of a cooking cavity at its other terminal. The lamp L is turned on/off in response to ON/OFF operations of the secondary safety switch 53.

A power relay 54 is connected to the other terminal of the secondary safety switch 53, and a drive motor DM and cooling fan motor FM are connected between the power relay 54 and the monitor switch 52. The drive motor DM is driven to turn a turntable. Power output switching means 60 is connected between the power relay 54 and a primary coil of a high-voltage transformer 70. The power relay 54 acts to control the supply of power from the secondary safety switch 53 to the switching means 60.

The power output switching means 60 includes a rectifier 61 for rectifying commercial alternating current (AC) power, and a switching circuit 63 for switching a direct current (DC) voltage from the rectifier 61 to the primary coil of the high-voltage transformer 70. To this end, the switching circuit 63 is provided with a plurality of switching devices. That is, the switching circuit 63 includes a first switching device Q1 and second switching device Q2 connected in series to the output of the rectifier 61. A first capacitor C1 is connected in parallel to the switching circuit 63. A second capacitor C2 and third capacitor C3 are connected in series to each other and in turn in parallel to the switching circuit 63.

A detailed description will hereinafter be given of a method for controlling the wall-mounted microwave oven with the above-stated construction in accordance with the present invention.

The control method of the present invention is performed to prevent the microwave oven and the hood unit from being operated at maximum power at the same time for a predetermined period of time in the initial operation state and then normally operate them after the lapse of the predetermined time period, thereby controlling the entire power consumption of the microwave oven and preventing the oven from being overloaded.

Figure 3A:
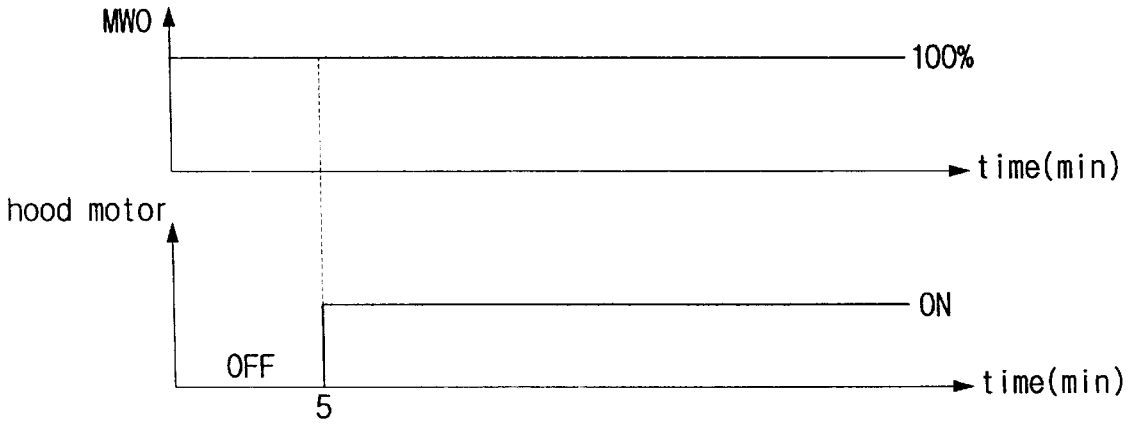
FIGS. 3*a* to 3*c* are graphs illustrating a method for controlling the wall-mounted microwave oven in accordance with the present invention.
Figure 4A:
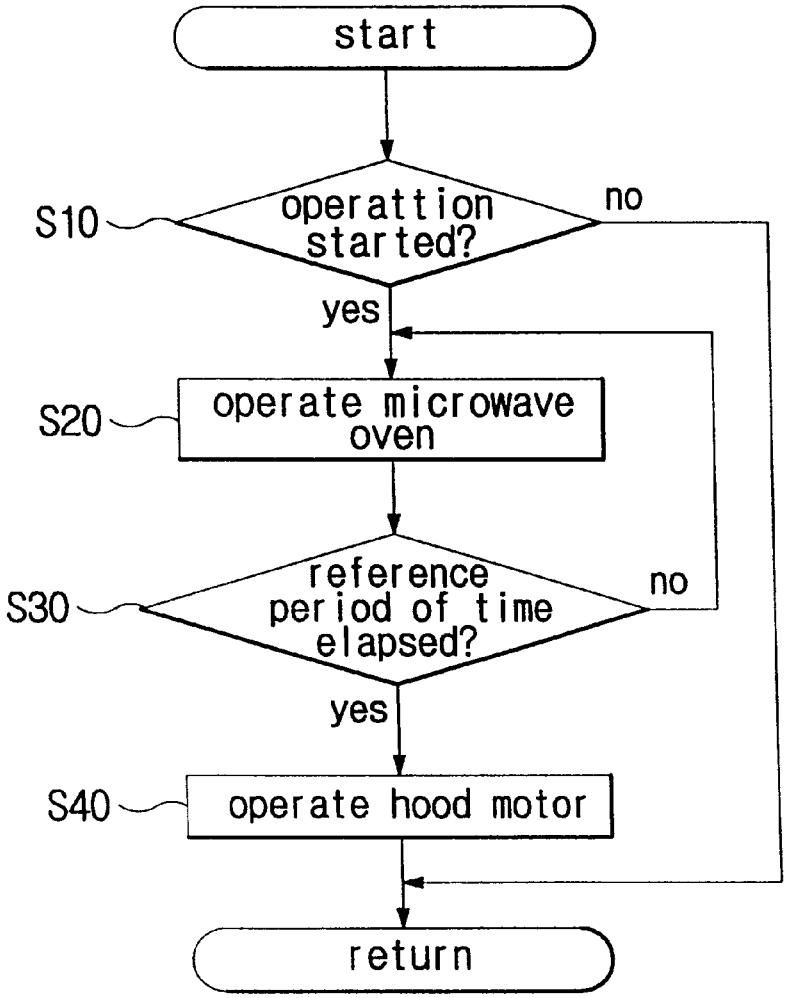
FIGS. 4*a* to 4*c* are flowcharts illustrating the method for controlling the wall-mounted microwave oven in accordance with the present invention.

FIGS. 3*a* and 4*a* illustrate a first embodiment of the control method for preventing the microwave oven and the hood unit from being operated at maximum power at the same time for a predetermined period of time in the initial operation state according to the present invention. In the first embodiment, the microwave oven is first operated in the initial operation state and the hood motor of the hood unit is then operated after the lapse of the predetermined time period, as will hereinafter be described in detail.

First, the controller 100 determines whether an operation start command, or a cooking start command, has been inputted by the key input unit 90 (S10). Upon determining at step S10 that the operation start command has been inputted by the key input unit 90, the controller 100 controls the PWM circuit 62 in the power output switching means 60 to turn on the first and second switching devices Q1 and Q2 so as to operate the microwave oven (S20).

If the microwave oven is operated, then the controller 100 determines whether a predetermined reference period of time has elapsed (S30). In case the predetermined reference time period is determined to have elapsed at step S30, the controller 100 controls the hood unit driver 120 to operate the hood motor HM (S40).

Figure 3B:
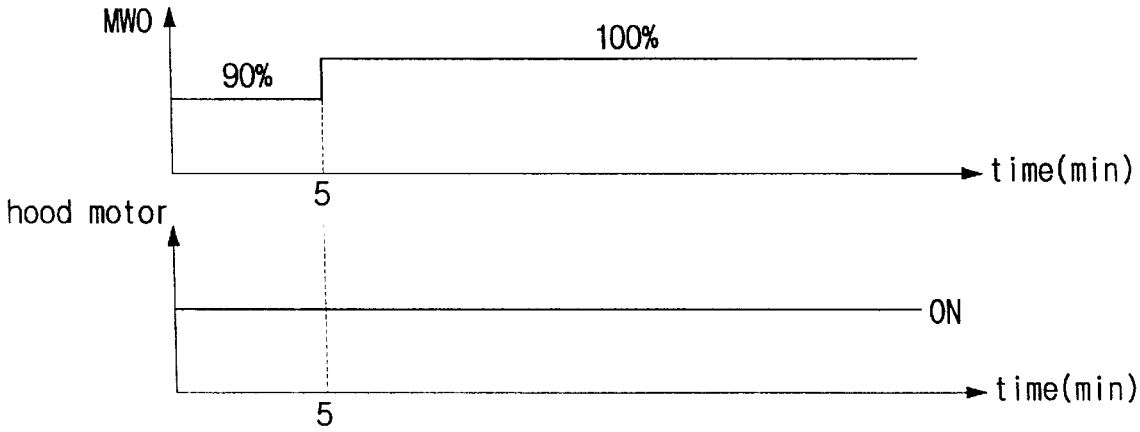
Figure 4B:
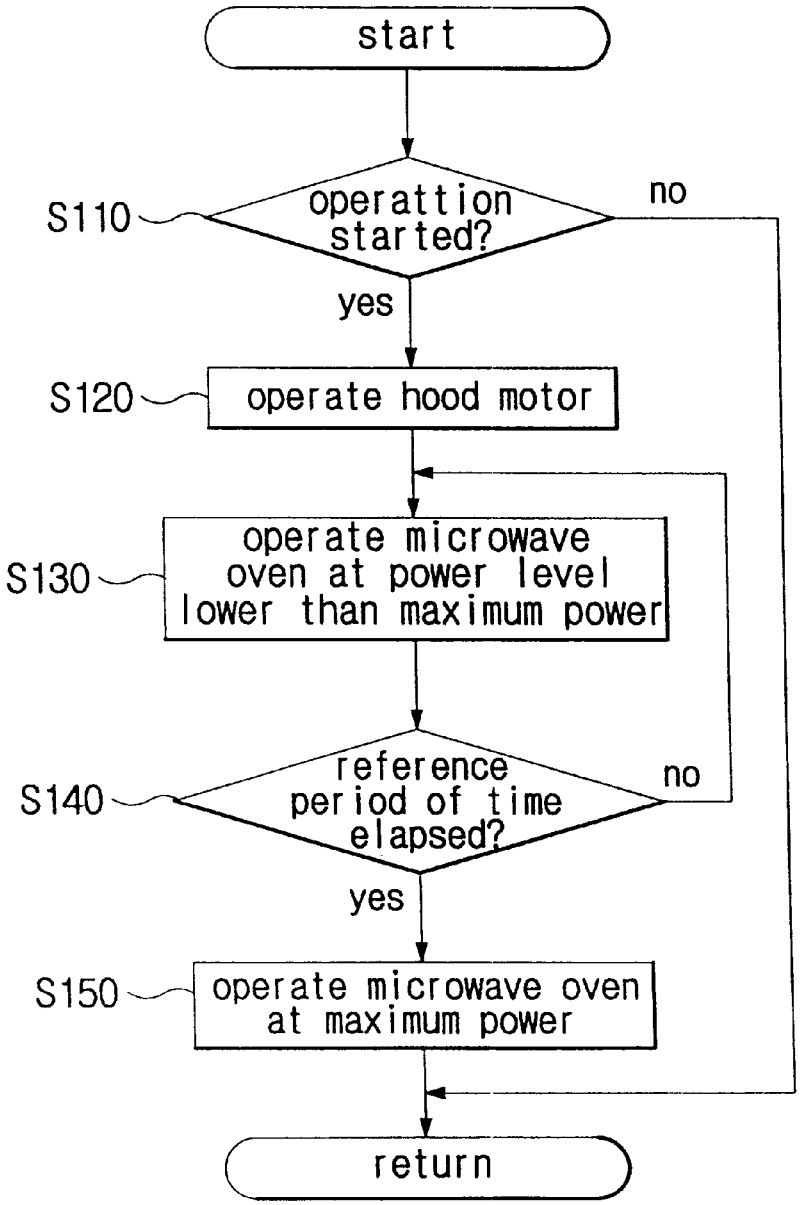

FIGS. 3*b* and 4*b* illustrate a second embodiment of the control method according to the present invention. In the second embodiment, in the initial operation state, the hood motor HM is normally operated and the microwave oven is operated at a power level lower than the maximum power for a predetermined period of time, as will hereinafter be described in detail.

First, the controller 100 determines whether an operation start command, or a cooking start command, has been inputted by the key input unit 90 (S110). Upon determining at step S110 that the operation start command has been inputted by the key input unit 90, the controller 100 controls the hood unit driver 120 to operate the hood motor HM (S120).

The controller 100 then controls the PWM circuit 62 such that a duty ratio of the first and second switching devices Q1 and Q2 has a value lower than the maximum duty ratio. That is, the controller 100 controls the PWM circuit 62 such that the microwave oven is operated at a power level lower than the maximum power (S130).

Thereafter, the controller 100 determines whether a predetermined reference period of time has elapsed (S140). In the case where it is determined at step S140 that the predetermined reference time period has elapsed, the controller 100 controls the PWM circuit 62 such that the duty ratio of the first and second switching devices Q1 and Q2 has the maximum value (for example, 100%). That is, the controller 100 controls the PWM circuit 62 such that the microwave oven is operated at the maximum power (S150).

Figure 3C:
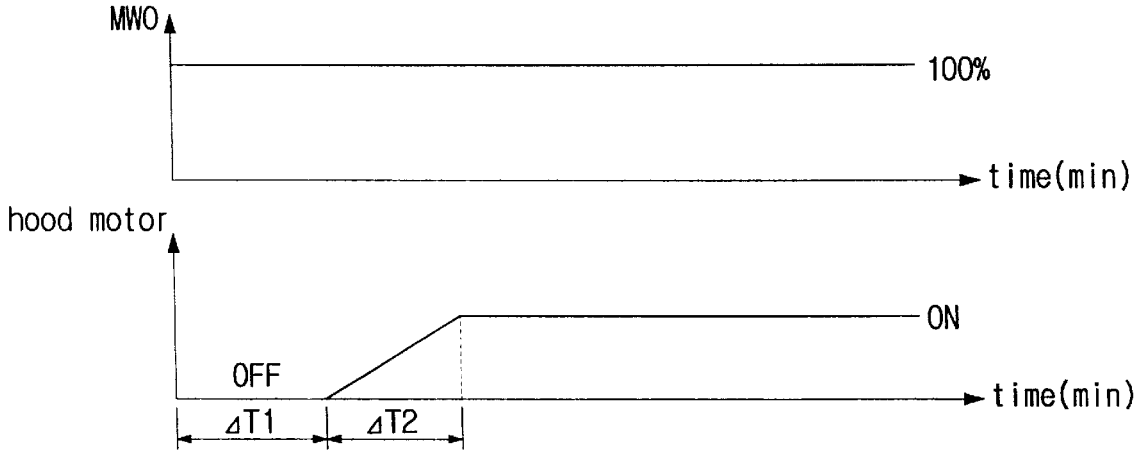
Figure 4C:
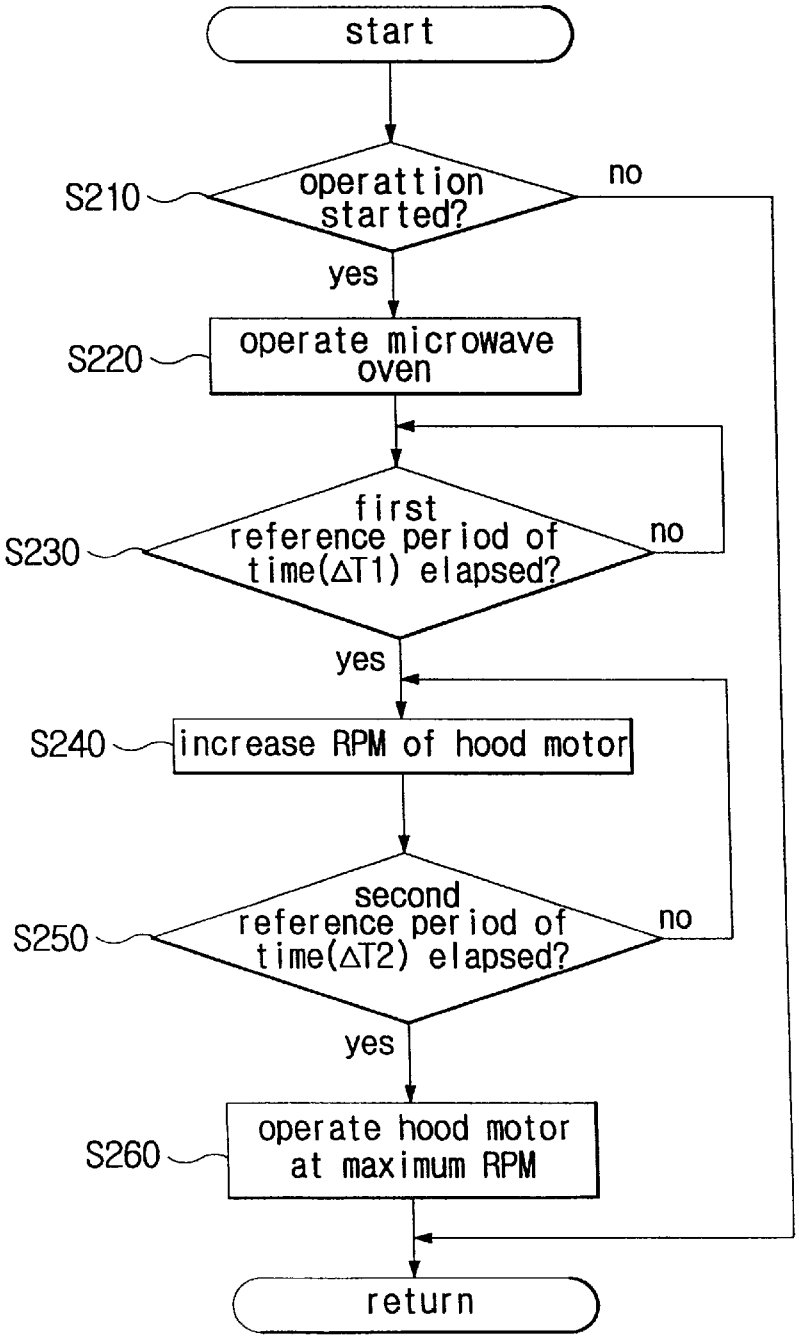

FIGS. 3*c* and 4*c* illustrate a third embodiment of the control method according to the present invention. In the third embodiment, the microwave oven is first operated in the initial operation state and, after the lapse of a predetermined period of time, the hood motor HM begins to operate and is then accelerated gradually, as will hereinafter be described in detail.

First, the controller 100 determines whether an operation start command, or a cooking start command, has been inputted by the key input unit 90 (S210). Upon determining at step S210 that the operation start command has been inputted by the key input unit 90, the controller 100 controls the PWM circuit 62 in the power output switching means 60 to turn on the first and second switching devices Q1 and Q2 so as to operate the microwave oven (S220).

If the microwave oven is operated, then the controller 100 determines whether a first predetermined reference period of time $\Delta T1$ has elapsed (S230). In case the first predetermined reference time period is determined to have elapsed at step S230, the controller 100 controls the hood unit driver 120 to operate the hood motor HM and gradually increase its RPM (S240).

Thereafter, the controller 100 determines whether a second predetermined reference period of time $\Delta T2$ has elapsed (S250). In the case where it is determined at step 250 that the second predetermined reference time period has elapsed, the controller 100 controls the hood unit driver 120 such that the hood motor HM is fully turned on, namely, it is operated at a predetermined maximum RPM (260).

Figure 5:
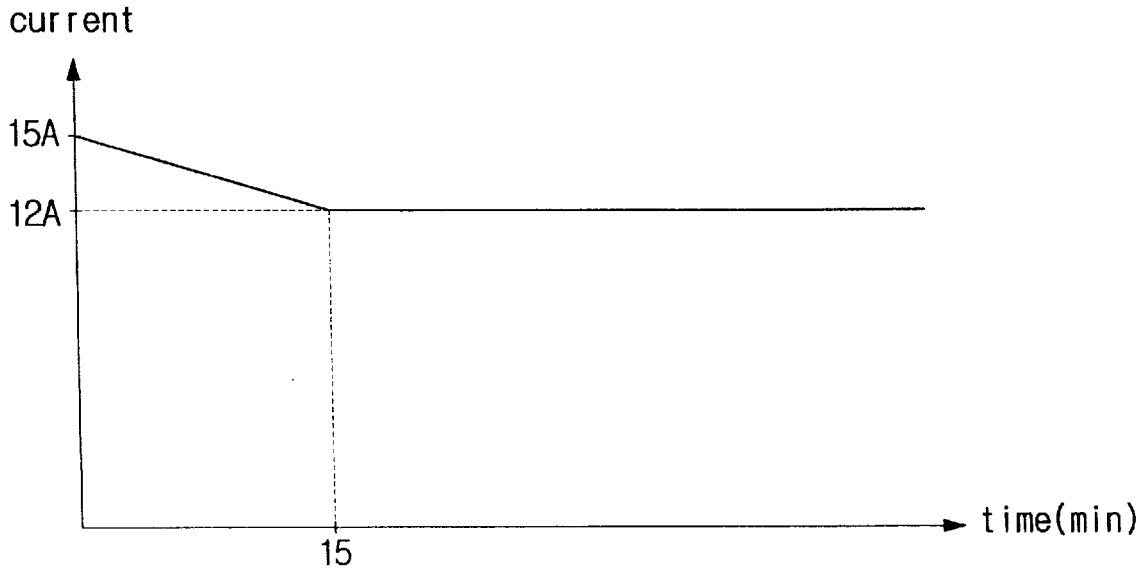
FIG. 5 is a graph illustrating characteristics of the wall-mounted microwave oven in accordance with the present invention.

FIG. 5 is a graph illustrating characteristics of the wall-mounted microwave oven in accordance with the present invention. It can be seen from this drawing that the present wall-mounted microwave oven is improved in its current consumption characteristics as compared with conventional ones.

In this manner, the power output of the microwave oven can be controlled according to a given operation mode of the hood motor. Therefore, the microwave oven can be prevented from being overloaded while outputting the maximum power within the range of the entire power consumption and the range of rated power.

As apparent from the above description, the present invention provides a wall-mounted microwave oven and a method for controlling the same, wherein the microwave oven and a hood unit are prevented from being operated at maximum power at the same time for a predetermined period of time in the initial operation state. Therefore, the microwave oven can be controlled in entire power consumption and prevented from being overloaded.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A wall-mounted microwave oven comprising:

a hood unit including a hood motor;

a magnetron;

a transformer having primary and secondary coils, said transformer generating a high voltage in a turn ratio of said primary and secondary coils and supplying the generated high voltage to said magnetron;

a hood unit driver for controlling an operation of said hood unit;

power output switching means for controlling the level of a voltage to be supplied to said transformer; and a controller regulating said hood unit driver and power output switching means by preventing said hood unit and magnetron from being operated at maximum power at the same time in an initial operation state and by enabling concurrent application of full power to both said hood unit and said magnetron after said initial operation state.

2. The microwave oven as set forth in claim 1, wherein said power output switching means includes:

a rectifier for converting a commercial alternating current (AC) voltage supplied to said microwave oven into a direct current (DC) voltage;

a switching circuit for switching said DC voltage from said rectifier to said primary coil of said transformer; and a pulse width modulation circuit for controlling a duty ratio of a switching control pulse signal to said switching circuit under the control of said controller.

3. A method for controlling a wall-mounted microwave oven, said microwave oven having a hood unit including a hood motor, said method comprising the steps of:

a) controlling said hood motor and microwave oven to prevent them from being operated at maximum power at the same time for a certain period of time in an initial operation state; and b) normally operating said hood motor and microwave oven at the maximum power after the lapse of the certain time period.

4. The method as set forth in claim 3, wherein said step a) includes the steps of:

a-1) operating said microwave oven; and a-2) operating said hood motor after the lapse of a predetermined reference period of time.

5. The method as set forth in claim 3, wherein said step a) includes the steps of:

a-1) turning on said hood motor;

a-2) operating said microwave oven at a predetermined power level lower than the maximum power for a predetermined reference period of time after said hood motor is turned on; and a-3) operating said microwave oven at said maximum power after the lapse of said predetermined reference time period.

6. The method as set forth in claim 3, wherein said step a) includes the steps of:

a-1) operating said microwave oven;

a-2) after the lapse of a first predetermined reference period of time, operating said hood motor and gradually increasing its RPM; and a-3) operating said hood motor at a maximum RPM after the lapse of a second predetermined reference period of time.

7. A wall-mounted microwave oven, comprising:

a hood unit comprising a hood motor and a driver controlling operation of said hood unit;

a magnetron;

a transformer generating and supplying a high voltage to said magnetron;

a power output switch controlling the level of a voltage to be supplied to said transformer; and a controller regulating said hood unit driver and power output switch by limiting initiation of operation of said hood unit and said magnetron during an initial period extending between an interval when no voltage is applied across said magnetron to a subsequent interval, and enabling application of full power simultaneously to both said hood unit and said magnetron during said subsequent interval.

8. The microwave oven as set forth in claim 7, wherein said power output switching means includes:

a rectifier converting a commercial alternating current voltage supplied to said microwave oven into a direct current voltage;

a switching circuit switching said direct current voltage from said rectifier to said primary coil of said transformer; and a pulse width modulation circuit controlling a duty ratio of a switching control pulse signal to said switching circuit under the control of said controller.

9. The microwave oven of claim 7, with said controller:

enables said power output switch to supply a highest level of said voltage to said magnetron; and initiates operation of said hood motor after the lapse of a predetermined reference period of time.

10. The microwave oven of claim 7, with said controller:

turns on said hood motor;

enables said power output switch to supply to said transformer a predetermined power level lower than maximum power for a predetermined reference period of time after said hood motor is turned on; and enables said power output switch to supply to said transformer said maximum power after the lapse of said predetermined reference time period.

11. The microwave oven of claim 7, with said controller:

enables said power output switch to supply a highest level of said voltage to said magnetron;

initiates operation of said hood motor after the lapse of a first predetermined reference period of time, and then gradually increasing the revolutions per minute of said hood motor; and operating said hood motor at a maximum revolutions per minute after the lapse of a second predetermined reference period of time.

* * * * *